US007683839B2

(12) United States Patent
Ollikainen et al.

(10) Patent No.: US 7,683,839 B2
(45) Date of Patent: Mar. 23, 2010

(54) MULTIBAND ANTENNA ARRANGEMENT

(75) Inventors: Jani Ollikainen, Helsinki (FI); Antero Lehtola, Turku (FI); Joonas Krogerus, Espoo (FI); Jussi Rahola, Espoo (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 11/479,651

(22) Filed: Jun. 30, 2006

(65) Prior Publication Data

US 2008/0122698 A1 May 29, 2008

(51) Int. Cl.

| | |
|---|---|
| ***H01Q 1/24*** | (2006.01) |
| ***H01Q 1/38*** | (2006.01) |
| ***H01Q 5/00*** | (2006.01) |
| ***H01Q 9/04*** | (2006.01) |
| ***H01Q 1/48*** | (2006.01) |

(52) U.S. Cl. ..... 343/702; 343/846; 343/700 MS

(58) Field of Classification Search ..... 343/700 MS, 343/702, 846, 848

See application file for complete search history.

(56) References Cited

U.S. PATENT DOCUMENTS

| | | | | |
|---|---|---|---|---|
| 6,118,379 | A * | 9/2000 | Kodukula et al. | 340/572.8 |
| 6,326,921 | B1 * | 12/2001 | Egorov et al. | 343/700 MS |
| 6,734,825 | B1 * | 5/2004 | Guo et al. | 343/700 MS |
| 2002/0021253 | A1 * | 2/2002 | Muramoto et al. | 343/702 |
| 2002/0047802 | A1 * | 4/2002 | Voipio | 343/700 MS |
| 2003/0030587 | A1 * | 2/2003 | Yuasa et al. | 343/700 MS |
| 2003/0193437 | A1 * | 10/2003 | Kangasvieri et al. | 343/702 |
| 2004/0233109 | A1 * | 11/2004 | Ying et al. | 343/700 MS |
| 2005/0184914 | A1 * | 8/2005 | Ollikainen et al. | 343/702 |

FOREIGN PATENT DOCUMENTS

WO WO 2008000891 A1 * 1/2008

OTHER PUBLICATIONS

J. Ollikainen, M. Fischer, and P. Vainikainen, "Thin dual-resonant stacked shorted patch antenna for mobile communications," Electronics Letters vol. 35, No. 6, pp. 437-438, Mar. 18, 1999.*

Yong-Xin Guo, Michael Yan Wah Chia, and Zhi Ning Chen, "Miniature Built-In Multiban Antennas for Mobile Handsets," IEEE Transactions on Antennas and Propagation, vol. 52, No. 8, Aug. 2004.*

Xu Jing, Zhengwei Du, and Ke Gong, "A Compact Multiband Planar Antenna for Mobile Handsets," IEEE Antennas and Wireless Propagation Letters, vol. 5, Mar. 24, 2006.*

Yazdandoost, "Ultra Wideband Antennas," IEEE Radio Communications, Jun. 2004).*

Written Opinion of the International Searching Authority of application PCT/FI2007/000181, Jan. 6, 2009.*

* cited by examiner

*Primary Examiner*—Douglas W Owens
*Assistant Examiner*—Jennifer F Hu
(74) *Attorney, Agent, or Firm*—Harrington & Smith

(57) ABSTRACT

The invention relates to a radio antenna and, more specifically, to an internal multiband antenna for use e.g. in a portable telecommunication device, such as a mobile phone. In particularly the invention relates to an antenna module for a mobile terminal including a non-resonant antenna element, two resonant antenna elements each covering at least any one of a first, second, third or fourth frequency band, said two resonant elements are substantially in the same plane and define a planar surface wherein the two resonant elements are each positioned at a corner of the planar surface and the non-resonant element is positioned along an edge of the planar surface.

22 Claims, 8 Drawing Sheets

Antenna 1 (GSM), $f$ = 915 MHz

Antenna 2 (UMTS), $f$ = 2.11 GHz

Antenna 3 (UMTS diversity), $f$ = 2.11 GHz

Antenna 1 (GSM), *f* = 915 MHz

Antenna 2 (UMTS), *f* = 2.11 GHz

Antenna 3 (UMTS diversity), *f* = 2.11 GHz

MULTIBAND ANTENNA ARRANGEMENT

TECHNICAL FIELD OF THE INVENTION

The invention relates to a radio antenna and, more specifically, to an internal multiband antenna for use e.g. in a portable telecommunication device, such as a mobile phone.

BACKGROUND OF THE INVENTION

Current wireless communication systems utilize several different radio communication standards and operate at many different frequency bands. In this fractured service environment, terminals operating in multiple systems and frequency bands offer a better service coverage than single-band and single-system terminals. One example of a multiband communication terminal is a mobile phone operating for example at four GSM bands, namely GSM850 (824-894 MHz), GSM900 (880-960 MHz), GSM1800 (1710-1880 MHz), GSM1900 (1850-1990 MHz) and further at the UMTS band (1920-2170 MHz).

Compact multiband antenna configurations with good performance are needed to realize multiband mobile terminals and/or base stations. Current mobile terminals typically have one multiband antenna and one feed for the GSM bands and another antenna and feed for UMTS. At the same time as the space for the antennas in the mobile terminal is becoming very limited, there is a need to fit more and more antennas inside the terminal, for example to implement mobile antenna diversity.

Antenna diversity can be and is used to improve the performance of radio devices in a multipath propagation environment. In antenna diversity, two or more antennas operating at the same frequency band are used to receive the same information over independently fading radio channels. When the signal of one channel fades, the receiver can rely on the other antenna(s) to offer a higher signal level. Alternatively, it is also possible to combine two or more signals in such a way that interference caused by other transmitting devices reduces. The price for improved performance is, however, increased complexity. Generally, diversity can provide, for example, better call quality, improved data rates, and increased network capacity without the use of extra frequency spectrum. Diversity can also provide longer battery life or duration. When implemented in mobile terminals, the benefits of antenna diversity can be utilized without investments in the network infrastructure. In mobile terminals, the use of multiple antennas for one system can also reduce the effect of the user on the antenna performance.

However, some problems relate also to sizes of antennas. One of the main problems of small antennas is small operation bandwidth. The bandwidth is interrelated with efficiency and antenna size so that one of the mentioned characteristics can only be improved (antenna size decreased) at the expense of others. For example, if a larger antenna bandwidth is needed for a new communication system or for implementing a new antenna function, such as diversity, the simplest way to do this is to increase the antenna size or to trade off some of the total efficiency. However, in small portable radio equipment neither one of the mentioned methods is desirable. Usually, they are accepted only in compelling circumstances.

Fortunately, there are known methods, such as, introducing multiple resonances with resonant matching circuits and parasitic elements, which can be used to increase the operation bandwidth up to a certain limit without degrading the efficiency. However, these methods typically increase the complexity of the antenna.

Furthermore, the performance of a small antenna in a relatively small terminal depends also on the location and orientation of the antenna(s) as well as the size and shape of the terminal. Finding suitable locations for the antenna in the terminal can be at least as important for the performance as the actual antenna structure.

To design compact and efficient internal handset antennas that operate e.g. at four GSM bands (GSM850/900/1800/1900) and the UMTS band is very challenging. The problem becomes even more difficult, if multiple antennas operating at a given frequency band, such as diversity antennas, have to be included in a mobile terminal. If total antenna size cannot be increased when a new antenna or operation band is added, the sizes of the existing antennas must then be decreased, which leads without exception to degradation of the performances of the existing antennas.

Further problems arise when two antennas operating at the same frequency range are placed close to each other because they tend to couple to each other. In diversity and MIMO (Multiple Input Multiple Output) applications, mutual coupling decreases the efficiency of the coupled antennas reducing the improvement from that, which would be possible with perfectly isolated antennas, which can be designed more independently. Furthermore, mutual coupling complicates antenna design as it causes modifications made to one antenna to affect also the others. Large isolation between antennas operating at different bands is also useful because it can allow simplifying the RF front end. However, it can be very challenging to design antennas that have e.g. over 10 dB isolation in the limited space allowed for internal antennas of modern mobile terminals.

In addition low correlation between antenna signals is a prerequisite for the improvement of the radio link performance with diversity or MIMO. Generally, it is not obvious that low correlation can be achieved in the small space allowed for the internal antennas of modern mobile terminals. In current mobile phones, various components such as a camera, speaker or both have often been located at least partly between the internal antenna element and its ground plane. These additional components can degrade the antenna performance. Thus it would be desirable to find antenna solutions that would enable the integration of other components in their proximity with minimal degradation of antenna performance.

Furthermore, the hand of a user can also be problematic for antenna performance, because it typically degrades the performance of mobile phone antennas at the frequency ranges in question (0.8 GHz-2.2 GHz). The effect is very strong when the hand is at least partly on top of the antenna, and unfortunately it is very common that the user often holds the phone so that the forefinger is on top of the antenna element near the top of the phone. It would be desirable to find antenna configurations in which internal antennas are placed so that the effect of the user's head, hand, or other body parts have a minimal influence on their performance.

Relating to the problems mentioned above, it is known that the bandwidth of a small antenna can be increased using resonant matching circuits and parasitic elements. Moreover, it is known that generally increasing the distance between antennas increases isolation between them. In addition, it is well accepted that the isolation depends on the relative orientation of the antennas.

However, according to the inventors' experience, when additional antennas are added between two antennas to be isolated, whether the isolation increases or decreases depends on the type of the additional antenna as well as its relative orientation to the antennas to be isolated. Hence, it is not obvious that merely locating any antenna or resonator between two antennas automatically increases isolation between them; it may also do the opposite.

SUMMARY OF THE INVENTION

The object of the invention is to provide a compact internal multiband mobile terminal antenna arrangement operating efficiently at all the commonly used cellular communication system bands and further enabling antenna diversity (and MIMO) and simple RF front end solutions. An additional object of the invention is that the compact internal multiband mobile terminal antenna arrangement has a sufficiently low envelope correlation (say $\rho<0.7$) between antenna signals for good diversity performance and sufficiently large isolation of about 10 dB or more.

The object of the invention is fulfilled, for example, with an antenna for a mobile terminal comprising a non-resonant antenna element, two resonant antenna elements each covering at least any one of a first, second, third or fourth frequency band, said two resonant elements are substantially in the same plane and define a planar surface wherein the two resonant elements are each positioned at a corner of the planar surface and the non-resonant element is positioned along an edge of the planar surface.

The following abbreviations are used in this document:

CDMA Code division multiple access
GPS Global positioning system
GSM Global system for mobile communications
IFA Inverted F-antenna
MIMO Multiple input multiple output
PIFA Planar inverted-F antenna
PWB Printed wiring board
RX Receive
TX Transmit
UMTS Universal mobile telecommunication system
WCDMA Wideband CDMA An exemplary embodiment of the invention relates to an antenna for a mobile terminal comprising a general ground element, one first separate lower band antenna covering the GSM850/900 frequencies and two second dual-resonant shorted patch antennas covering the GSM1800/1900/UMTS frequencies, wherein each of said antennas comprise a leg portion containing a feed arrangement for feeding the antenna against the ground element.

According to an advantageous embodiment of the present invention both of the two second antennas are adapted to cover the GSM1800, GSM1900, and UMTS frequencies. According to this embodiment of the invention the first of said two second antennas can be used as a main (GSM/UMTS) antenna and the second of said two second antennas as a diversity antenna. Alternatively, according to this embodiment the first of said two second antennas can be used as a main GSM antenna and UMTS diversity antenna, and the second of said two second antennas can be used as a main UMTS antenna and GSM diversity antenna.

In addition, if diversity is not needed, the first of said two second antennas can be used as a separate TX antenna and the second of said two second antennas is used as a RX antenna for GSM1800/1900/UMTS according to an embodiment of the present invention. Because said two second antennas (covering GSM1800/1900/UMTS) cover both TX and RX bands, it is also possible to use the antennas for TX and RX diversity as well as for MIMO. Furthermore in the case of separate TX and RX antenna application, it is possible to make the antennas considerably smaller because considerably smaller bandwidths will suffice (e.g. it will be enough to have 280 MHz+365 MHz instead of 2×460 MHz).

Still according to an advantageous embodiment of the present invention the first separate lower band antenna and the first of said two second dual-resonant antennas can be adapted to cover the four GSM bands (GSM850/900/1800/1900) and the second of said two second dual-resonant antennas a separate UMTS antenna. This case also allows a considerable size reduction of two second dual-resonant antennas because of smaller bandwidth requirements. Because of suitable input impedances and large isolation between the first lower band antenna and two second dual-resonant antennas, it is possible to directly combine the separate feeds into one feed port to make the antenna module compatible with currently used RF front ends. Only minor adjustments in the antenna geometry are needed to re-optimize the performance.

Furthermore, by inserting short sections of transmission line between the feeds of the first lower band antenna and at least one of the two second antennas so that the first lower band antenna has optimally high impedance at GSM1800/1900/UMTS bands and said at least one of the two second antennas has optimally high impedance at GSM850/900 bands, the isolation between the ports can be maximized and no optimization is needed after combining the ports.

In addition, the two second antennas can be implemented according to a first embodiment of the present invention by two second dual-resonant coplanar shorted patch antennas. Still, the two second dual-resonant shorted patch antennas can be implemented according to a second embodiment of the present invention by two second dual-resonant stacked shorted patch antennas.

According to a further advantageous embodiment of the present invention the first separate lower band antenna is a T-shaped lower band element. The purpose of the T-shaped lower band element is to excite the longitudinally dipole-like resonant mode of the ground element. The folded T-shaped element itself is non-resonant, but is resonated with a separate matching circuit that provides a suitable parallel inductance and transforms the impedance.

The matching circuit is here realized as a short-circuited section of microstrip line. However, it could also be realized (at least partly) with any other known microwave technology, such as lumped components. According to an embodiment of the invention the matching circuit is located in the center area between the two second dual-resonant shorted patch antennas. It could as well be located closer to one of said two second dual-resonant shorted patch antennas or even on the opposite side of the ground plane, which would free the center area for some other purpose.

Because the first lower band antenna is implemented (according to an embodiment) with a separate feed, a multiresonant matching circuit can be easily added and optimized. However, the feed of the first lower band antenna can be combined with one of the upper band elements so that it is compatible with currently used front end solutions. It should also be possible to design a multiband matching circuit to the first lower band antenna so that it would operate also at GSM1800/1900 bands and perhaps even at the UMTS band, if necessary.

According to an embodiment of the present invention the two second antennas are advantageously positioned essentially symmetrically at the ground element corners. Furthermore the antennas are advantageously positioned as far away from each other as a form of the general ground element allows. In addition the antennas are advantageously positioned as far away from each other as a metal chassis of the mobile terminal allows. Still the first separate lower band antenna can be arranged to extend at least partly outside the general ground element or printed circuit board (PWB), or alternatively to locate totally on top of the general ground element or printed circuit board (PWB).

The present invention offers remarkable advantages over known prior art operating efficiently at all the commonly used cellular communication system bands. Further it for example enables the construction of a compact quad-band GSM and UMTS antenna that includes a tripleband diversity antenna. Alternatively it enables the separation of RX and TX functions of GSM1800/1900/UMTS into separate antennas, which can help simplify the RF front end. The separated TX and RX antennas have as good isolation as possible.

Current mobile terminals typically have only one multiband antenna and one feed for the GSM bands and another antenna and feed for UMTS. The isolation between the TX and RX bands is achieved using switches and filters. Separating the TX and RX functions into separate antennas as in the present invention could provide some of the necessary isolation between the TX and RX bands and enable the use of a simpler and less costly filtering solution in the RF front end.

Further the antenna module according to the invention has sufficiently low envelope correlation ($\rho e<0.7$) for good diversity performance, and sufficiently large isolation of about 10 dB or more between the signals of the two GSM1800/1900/UMTS antennas can be achieved simultaneously. Moreover diversity antenna has wide bandwidth covering GSM1800/1900 and UMTS bands; 1710 MHz-2170 MHz and good efficiency.

In addition adding the lower-GSM band element does not considerably increase coupling (decrease isolation) between the antennas. The separation of lower (850/900) and upper (1800/1900) GSM bands into different antennas allows independent optimization of the antennas making it easier e.g. to make the elements for both bands dual-resonant or multiresonant (and more wide-band). Owing to large isolation between lower and upper GSM bands, separate feeds can be easily combined if required by the RF front end architecture.

All antennas are located in a fairly small volume and can be positioned e.g. near the top of a monoblock phone so that they are not likely to be covered by the user's hand. All antennas can be integrated into one antenna module, which simplifies manufacturing (assembly) of terminals. Because all antennas are located close to each other, the transmitters and receivers can also be placed close to each other (integrated) and thus long and lossy RF lines are avoided. Additionally a mobile terminal has only a limited number of good antenna locations, whereupon a compact antenna module with so many antennas saves antenna locations for other, e.g. complementary (or non-cellular) radio antennas.

The invention relates to an antenna for a communication device comprising a non-resonant antenna element, two resonant antenna elements each covering at least any one of a first, second, third or fourth frequency band, said two resonant elements are substantially in the same plane and define a planar surface wherein the two resonant elements are each positioned at a corner of the planar surface and the non-resonant element is positioned along an edge of the planar surface, and further to an antenna module comprising said antenna.

The invention further relates to an antenna module comprising a non-resonant antenna element, two resonant antenna elements covering at least any one of a first, second, third or fourth frequency band, said two resonant elements are substantially in the same plane and define a planar surface and said two resonant elements are each positioned at a corner of the planar surface and the non-resonant element is positioned along an edge of the planar surface, wherein the antenna module couples to a printed circuit board comprising a ground plane and a matching circuit and the non-resonant element, matching circuit and ground plane form a third resonant element covering a fifth frequency range, and further to a mobile terminal comprising said antenna module.

In addition the invention further relates to a method of operating a mobile terminal for a mobile communication network, the mobile terminal having an antenna module and a general ground element, the antenna module comprising a one first separate lower band antenna covering the GSM850/900 frequencies and two second dual-resonant shorted patch antennas covering the GSM1800/1900/UMTS frequencies, wherein each of said antennas comprise a leg portion containing a feed arrangement for feeding the antenna against the ground element, wherein the method comprises the steps of:

the first separate lower band antenna is used for the GSM850/900 frequencies, and at least one of the two second dual-resonant shorted patch antennas is used for the GSM1800/1900/UMTS frequencies.

BRIEF DESCRIPTION OF THE DRAWINGS

Next the invention will be described in greater detail with reference to exemplary embodiments in accordance with the accompanying drawings, in which.

DETAILED DESCRIPTION

Figure 1B:
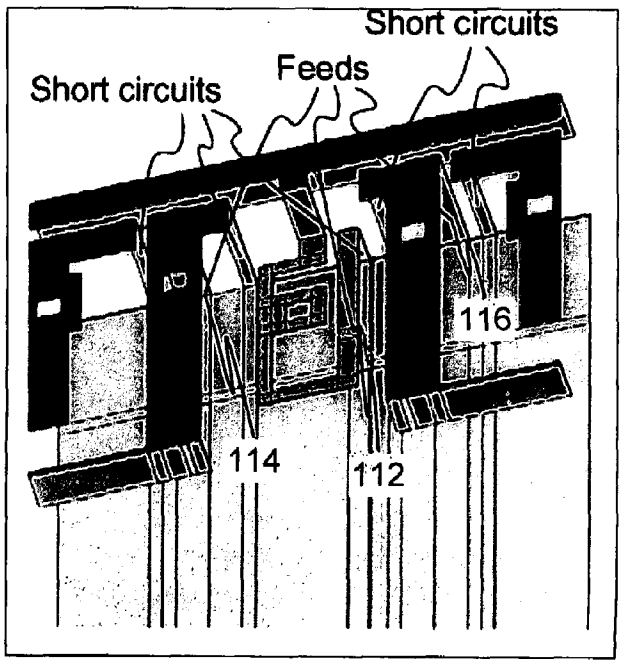
FIGS. 1*a* & 1*b* illustrate a first exemplary arrangement for an antenna module according to an advantageous embodiment of the invention.
Figure 1A:
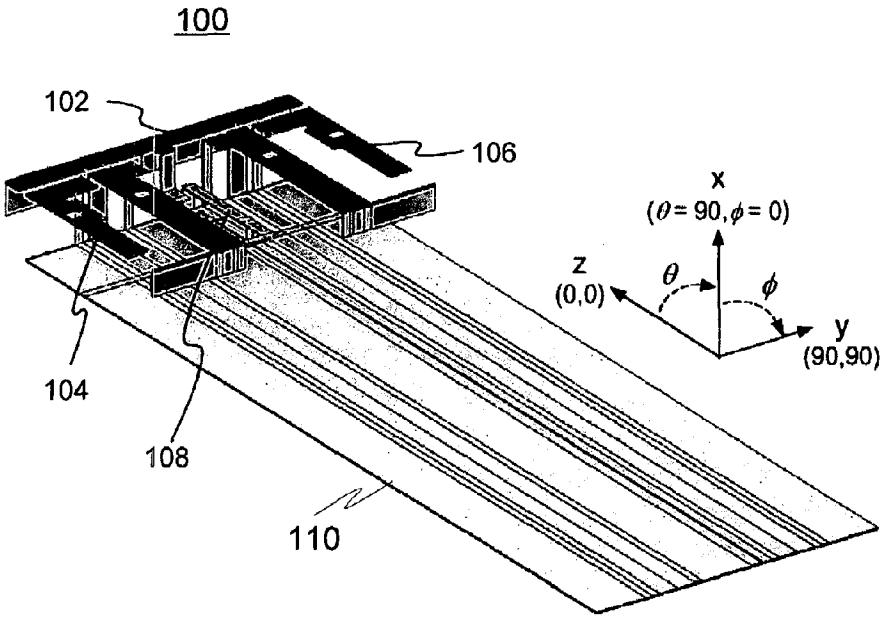

FIGS. 1*a* & 1*b* illustrate a first exemplary arrangement for an antenna module 100 according to an advantageous embodiment of the invention, where the antenna module 100 consists of a separate lower band antenna 102, which is advantageously designed for the GSM850 (824-894 MHz) and E-GSM900 bands. In addition, the antenna module 100 comprises two dual-resonant coplanar shorted patch antennas 104, 106. The two dual-resonant coplanar shorted patch antennas 104, 106 are advantageously located symmetrically at the corners of the ground element 110.

In alternative embodiments the dual resonant coplanar shorted patch antennas may be any antenna element, for example it could be a resonant or non-resonant antenna element. A non-resonant antenna element may be made resonant with the use of a matching circuit and coupled to a ground plane structure. The use of a dual resonant antenna element is a preferred embodiment as this will allow operation at multiple frequency bands.

The two dual-resonant coplanar shorted patch antennas 104, 106 both cover advantageously the GSM1800, GSM1900, and UMTS frequencies. They could also be used e.g. so that for example antenna 104 is the main (GSM/UMTS) antenna and antenna 106 is the diversity antenna. Alternatively, antenna 104 could be used as the main GSM antenna and UMTS diversity antenna, whereas antenna 106 is used as the main UMTS antenna and GSM diversity antenna. If diversity is not needed, antennas 104, 106 could be used as separate TX and RX antennas. In that case, their sizes can be decreased because the required operation bandwidths are smaller.

The lower band antenna 102 comprises advantageously a T-shaped element, which in this implementation extends partly outside the printed circuit board (PWB), and a separate matching circuit 108 that provides a suitable parallel inductance for resonating the antenna and transforms the input impedance level. Alternatively the T-shaped element can also be located totally on top of the PWB. The matching circuit 108 is here realized as a short-circuited section of microstrip line. However, it could also be realized (at least partly) with any other known microwave technology, such as lumped components. In this embodiment, the matching circuit 108 is located in the center area between the two antennas 104, 106. It could as well be located closer to e.g. antenna 104 or even on the opposite side of the ground element 110, which would free the center area for some other purpose, such as a camera or speaker. Because the lower GSM-band antenna 102 is implemented with a separate feed 112, a multiresonant matching circuit can be easily added and optimized. The feed 112 of the antenna 102 can be combined with one 114, 116 of the upper band antennas 104, 106 so that it is compatible with currently used front end solutions.

In this embodiment the largest dimensions of the antenna module 100 are 40 mm×29.4 mm×8.2 mm (W×L×H). It occupies a total volume of 9.6 $cm^3$ (open space between the two dual-resonant coplanar shorted patch antennas 104, 106 has not been subtracted). It may still be possible to make the two dual-resonant coplanar shorted patch antennas 104, 106 more compact and to increase the open space between them. The antenna module 100 in FIGS. 1*a* & 1*b* is attached to a 40 mm×115.2 mm×0.2 mm (W×L×H) ground element 110. The top part of the antenna extends 4 mm outside the ground element 110. The total length of the phone model is 119.2 mm. The antennas 102, 104, 106 and the ground element 110 were photoetched from 0.2 mm-thick sheet of tin bronze.

Figure 2A:
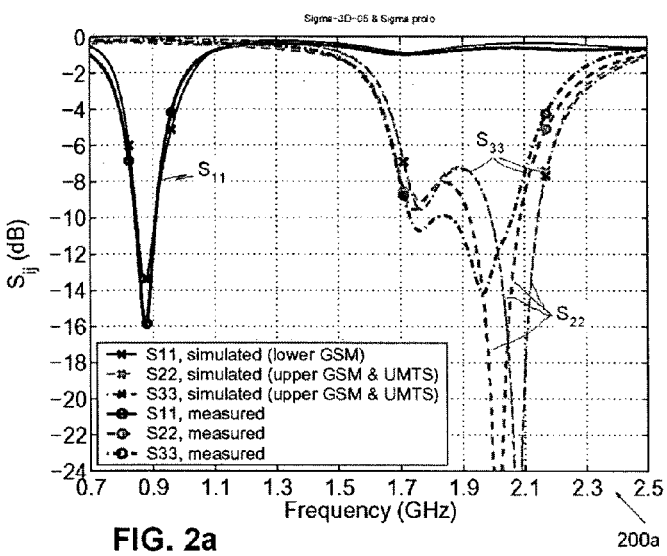
FIGS. 2*a*-2*c* illustrate simulated and measured frequency responses of S-parameters for the first exemplary arrangement for an antenna module in free space.
Figure 2B:
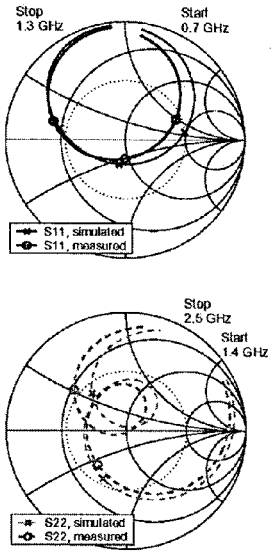
Figure 2B:
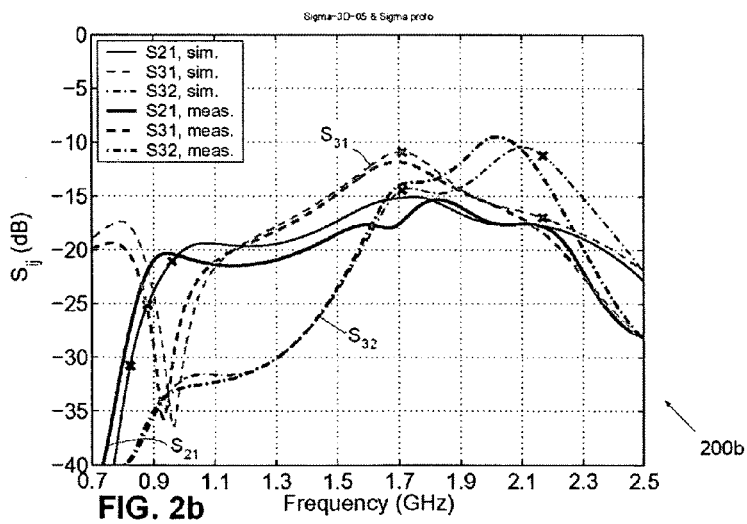

FIGS. 2*a* & 2*b* illustrate simulated and measured frequency responses of S-parameters for the first exemplary arrangement of an antenna module 100 (described in FIGS. 1*a* & 1*b*) according to the embodied invention in free space. Especially a graph 200*a* in FIG. 2*a* illustrates simulated and measured reflection coefficients ($S_{11}$, $S_{22}$, $S_{33}$) and a graph 200*b* in FIG. 2*b* simulated and measured couplings ($S_{21}$, $S_{31}$, $S_{32}$) between antennas. Markers on $S_{11}$ curve are at 824, 960, 1710, and 2170 MHz, and markers on $S_{22}$ & $S_{33}$ curve are at 1710 and 2170 MHz. The simulations can be performed, for example, with some commercially available Method of Moments (MoM) based full-wave electromagnetic simulator. A graphs 200*a* and 200*b* have x-axes denoting frequency in GHz units and y-axes denoting magnitudes of S parameters in dB units.

The measured and simulated results agree well enough to prove the functionality of the antenna concept. The measured center frequencies of two dual-resonant coplanar shorted patch antennas are slightly too low, but they can be easily corrected by shortening the strips so that at least a 6 dB return loss is obtained over the upper GSM and UMTS frequencies.

Also the simulated and measured couplings between the antennas (a chart 200*b* in FIG. 2*b*) show the same features. Despite the slight detuning of the upper band, the 10 dB isolation suggested by the simulated result can be obtained also in the measurements.

Figure 2C:
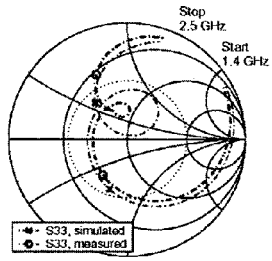

FIG. 2*c* illustrates a Smith's diagram for the corresponding curves illustrated in chart 200*a* in FIG. 2*a*.

Figure 3A:
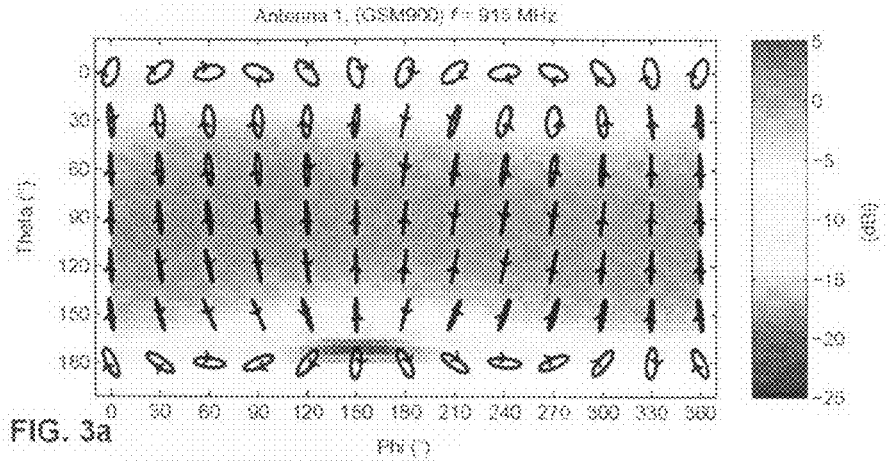
FIGS. 3*a*-3*c* illustrate examples of simulated 3-D radiation patterns showing total realized gain (dBi) and polarization ellipses for the first exemplary arrangement for an antenna module in free space.
Figure 3B:
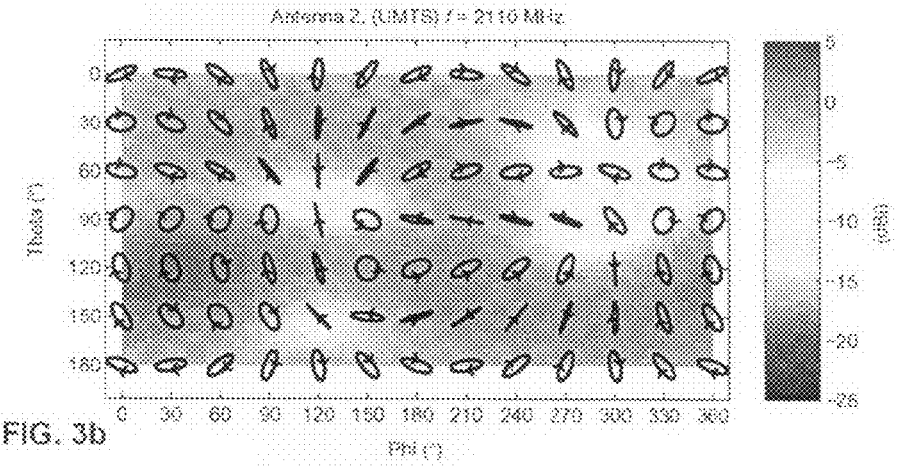
Figure 3C:
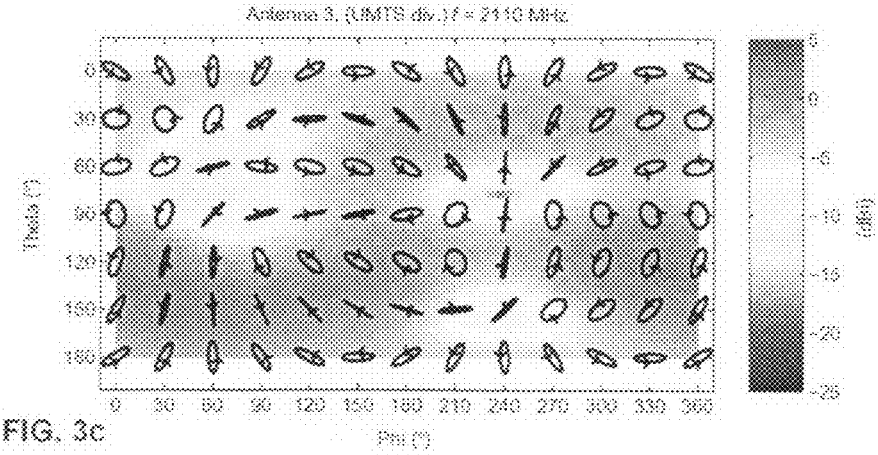

FIGS. 3*a*-3*c* illustrate examples of simulated three dimensional (3-D) radiation patterns showing total realized gain (dBi) and polarization ellipses for the first exemplary arrangement of an antenna module 100 (described in FIGS. 1*a* & 1*b*) according to the embodied invention in free space, especially for the first lower band antenna 102 (denoted in FIG. 3*a* as an Antenna 1) at 915 MHz and for the two dual-resonant coplanar shorted patch antennas 104, 106 (denoted in FIGS. 3*b* & 3*c* as an Antenna 2 and an Antenna 3, respectively) at 2110 MHz.

The plots show the total realized gain ($G_{r,\theta}+G_{r,\phi}$) and polarization ellipses in different directions. The arrows in the polarization ellipses indicate the handedness of the polarization. As expected, at 915 MHz the free space radiation pattern of the prototype resembles that of a half-wave dipole, which indicates that the radiation mainly comes from the longitudinally half-wave dipole-like resonant currents of the ground plane. The patterns of the two dual-resonant coplanar shorted patch antennas 104, 106 (FIGS. 3*b* & 3*c*) show that the decorrelation between the antenna signals is mainly due to the different polarizations of the antennas in different directions. The main beams point to slightly different directions, but the effect of this is assumed smaller than that of the different polarizations.

In the FIGS. 3*a*-3*c*, x-axes denote $\phi$ in degree units and y-axes denote $\theta$ in degree units in the standard spherical coordinate system used for antennas. The orientation of the antenna is given by the coordinate axes in FIGS. 1*a* & 1*b*, where x-axes point to the direction $\theta=90°$ and $\phi=0°$, y-axes point the direction $\theta=90°$ and $\phi=90°$, and z-axes point to the direction $\theta=0°$ and $\phi=0°$ in the standard spherical coordinate system.

Figure 4A:
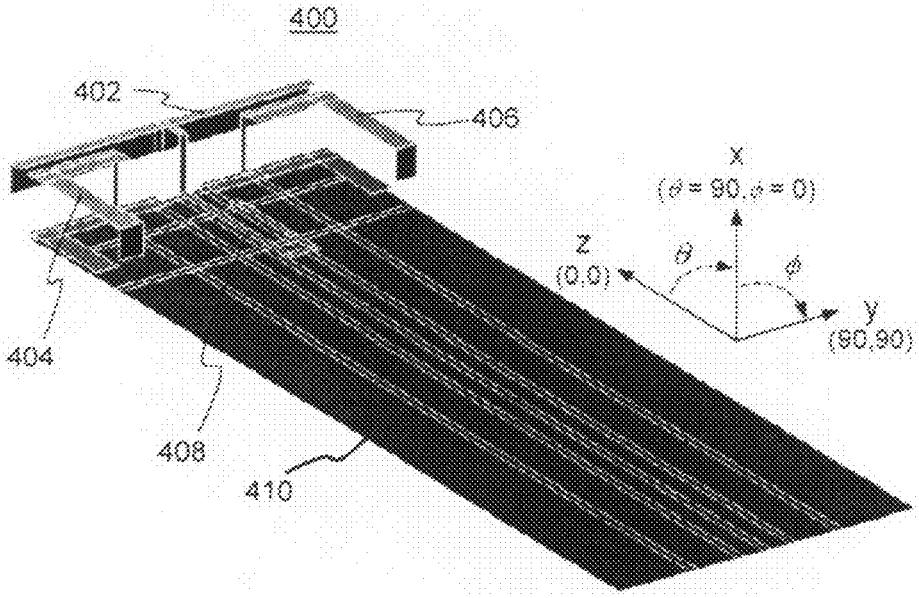
FIGS. 4*a* & 4*b* illustrate a second exemplary arrangement for an antenna module according to an advantageous embodiment of the invention.
Figure 4B:
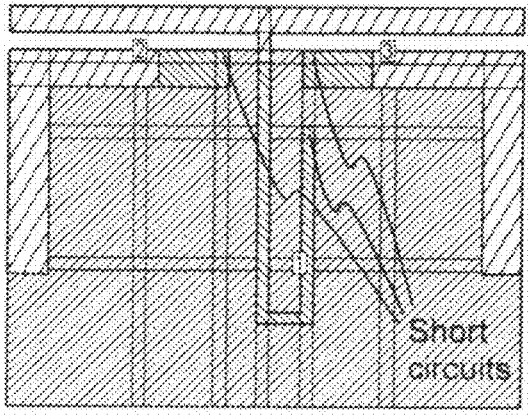

FIGS. 4*a* & 4*b* illustrate a second exemplary arrangement for an antenna module 400 according to an advantageous embodiment of the invention, where the antenna module 400 also consists of a separate lower band antenna 402, which is advantageously designed for the GSM850 (824-894 MHz) and E-GSM900 bands. In addition, the antenna module 400 comprises two dual-resonant stacked shorted patch antennas 404, 406. The two dual-resonant stacked shorted patch antennas 404, 406 are advantageously located symmetrically at the corners of the ground element 410.

The two dual-resonant stacked shorted patch antennas 404, 406 both cover advantageously the GSM1800, GSM1900, and UMTS frequencies. They could also be used e.g. so that for example antenna 404 is the main (GSM/UMTS) antenna and antenna 406 is the diversity antenna. Alternatively, antenna 404 could be used as the main GSM antenna and UMTS diversity antenna, whereas antenna 406 is used as the main UMTS antenna and GSM diversity antenna. If diversity is not needed, they antennas 406, 406 could be used as separate Tx and Rx antennas.

The purpose of the lower band antenna 402 is to excite the longitudinally dipole-like resonant mode of the ground plane 410. The lower band antenna 402 itself is non-resonant. It is resonated with a separate matching circuit 408, which provides a suitable parallel inductance and transforms the impedance. The matching circuit 408 is here realized as a short-circuited section of microstrip line, but it could be realized also with any other known microwave technology, such as lumped components. In this embodiment, the matching circuit 408 is located in the center area between the two dual-resonant stacked shorted patch antennas 404, 406. The matching circuit 408 could as well be located closer to e.g. antenna 404 or even on the opposite side of the ground element 410, which would free the center area for some other purpose, such as a camera. It should also be possible to design a multiband matching circuit to the first lower band antenna 402 so that it would operate also at GSM1800/1900 bands and perhaps even at the UMTS band, if necessary. In this embodiment the largest dimensions of the antenna module are 40 mm×21.5 mm×8 mm (W×L×H). The upper and lower strips of the two dual-resonant stacked shorted patch antennas 404, 406 are only 3 mm wide. Excluding the matching circuit 410, the antenna module occupies a volume of less than 2.8 $cm^3$. The volume of one antenna of the two dual-resonant stacked shorted patch antennas 404, 406 is slightly less than 0.8 $cm^3$. Adding a second of the two dual-resonant stacked shorted patch antennas 404, 406 (diversity antenna) can be estimated to increase the total antenna volume by 38%. The antennas are attached to a 40 mm×115 mm (W×L) ground plane 410. Because the first lower band antenna 402 is not on top of the ground-plane 410, it increases the total length of the phone model to 118.5 mm.

Figure 5B:
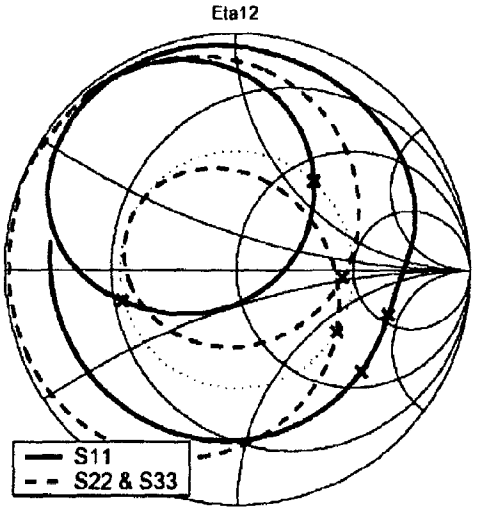
FIGS. 5*a* & 5*b* illustrate frequency responses of S-parameters for the second exemplary arrangement for an antenna module.
Figure 5A:
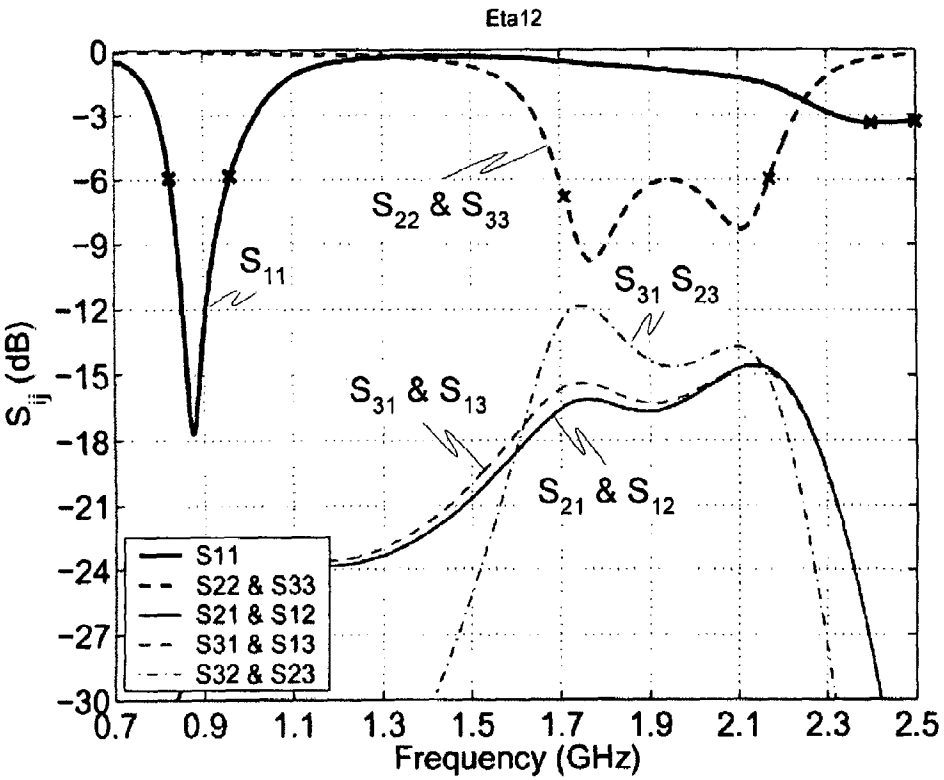

FIGS. 5*a* & 5*b* illustrate simulated frequency responses of S-parameters for the second exemplary arrangement of an antenna module 400 (described in FIGS. 4*a* & 4*b*) according to the embodied invention. Markers on $S_{11}$ curve are at 824, 960, 2400, and 2500 MHz, and markers on $S_{22}$ & $S_{33}$ curve are at 1710 and 2170 MHz. The simulations can be performed, for example, with some commercially available Method of Moments (MoM) based full-wave electromagnetic simulator. A graph in FIG. 5*a* has x-axis denoting frequency in GHz units and y-axis denoting magnitudes of S parameters in dB units.

The first lower band antenna covers the GSM850 and E-GSM900 bands with $L_{retn} \geqq 6$ dB. When the ground element length is reduced, the size of the first lower band antenna must be increased to obtain the same bandwidth. The first lower band antenna has a resonance also near 2.45 GHz, which is quite poorly matched ($L_{retn} \geqq 3$ dB) in the presented embodiment. However, by optimizing the design, it should be possible to obtain $L_{retn} \geqq 6$ dB over the Bluetooth (WLAN) band. The two dual-resonant stacked shorted patch antennas cover the GSM1800, GSM1900 and UMTS bands with $L_{retn} \geqq 6$ dB. The minimum isolation between these two dual-resonant stacked shorted patch antennas is around 12 dB.

Figure 6A:
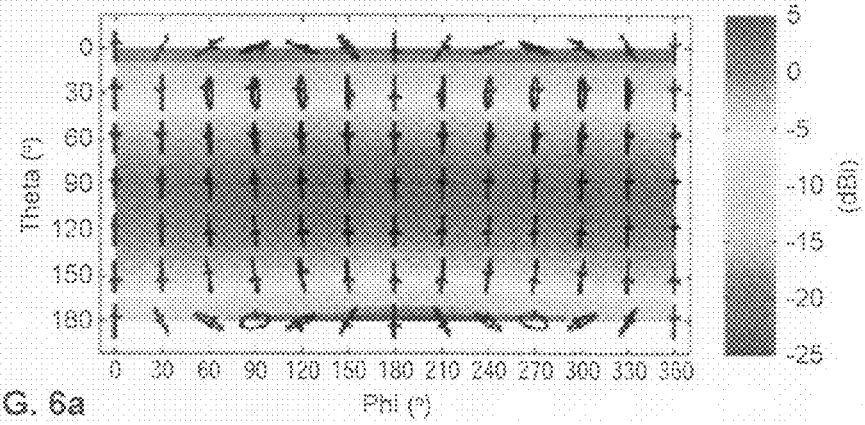
FIGS. 6*a*-6*c* illustrate examples of simulated 3-D radiation patterns showing total realized gain (dBi) and polarization ellipses for the second exemplary arrangement for an antenna module.
Figure 6B:
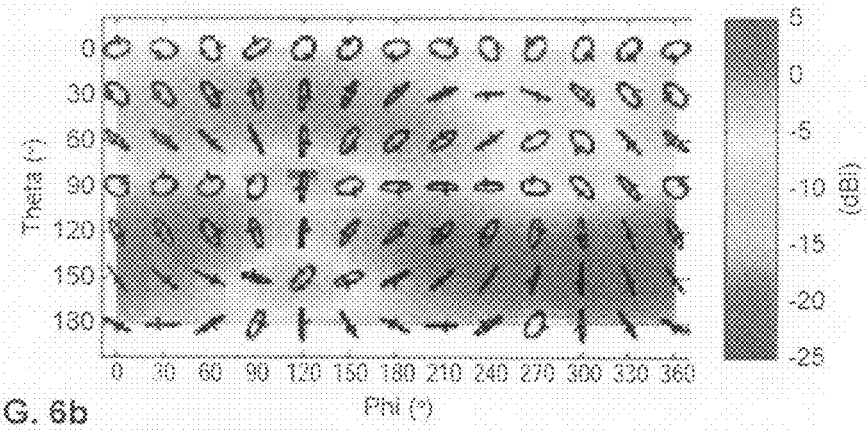
Figure 6C:
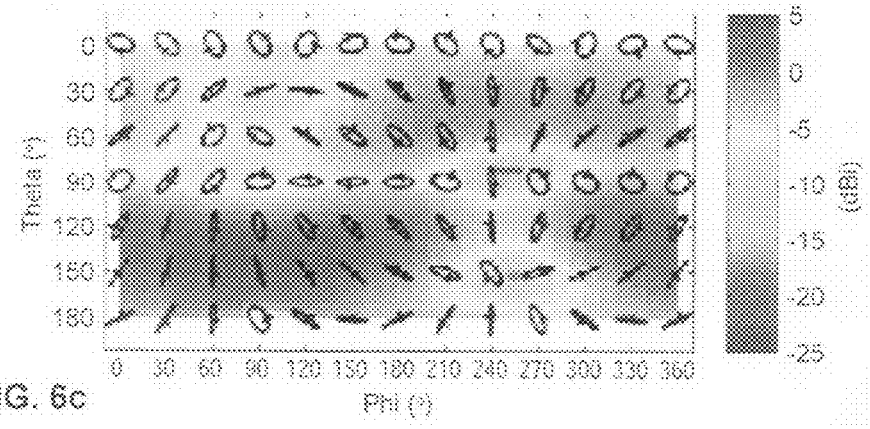

FIGS. 6*a*-6*c* illustrate examples of simulated three dimensional (3-D) radiation patterns showing total realized gain (dBi) and polarization ellipses for the second exemplary arrangement for an antenna module 400 (described in FIGS. 4*a* & 4*b*) according to the embodied invention, especially for the first lower band antenna 402 (denoted in FIG. 6*a* as an Antenna 1) at 915 MHz and for the two dual-resonant stacked shorted patch-antennas 404, 406 (denoted in FIGS. 6*b* & 6*c* as an Antenna 2 and an Antenna 3, respectively) at 2110 MHz.

The plots show the total realized gain ($G_{r,\theta}+G_{r,\phi}$) and polarization ellipses in different directions. In the FIGS. 6*a*-6*c* x-axes denote $\phi$ in degree units and y-axes denote $\theta$ in degree units in the standard spherical coordinate system used for antennas. The orientation of the antenna is given by the coordinate axes in FIGS. 4*a* & 4*b*, where x-axes point to the direction $\theta=90°$ and $\phi=0°$, y-axes point the direction $\theta=90°$ and $\phi=90°$, and z-axes point to the direction $\theta=0°$ and $\phi=0°$ in the standard spherical coordinate system.

Figures 7A, 7B:
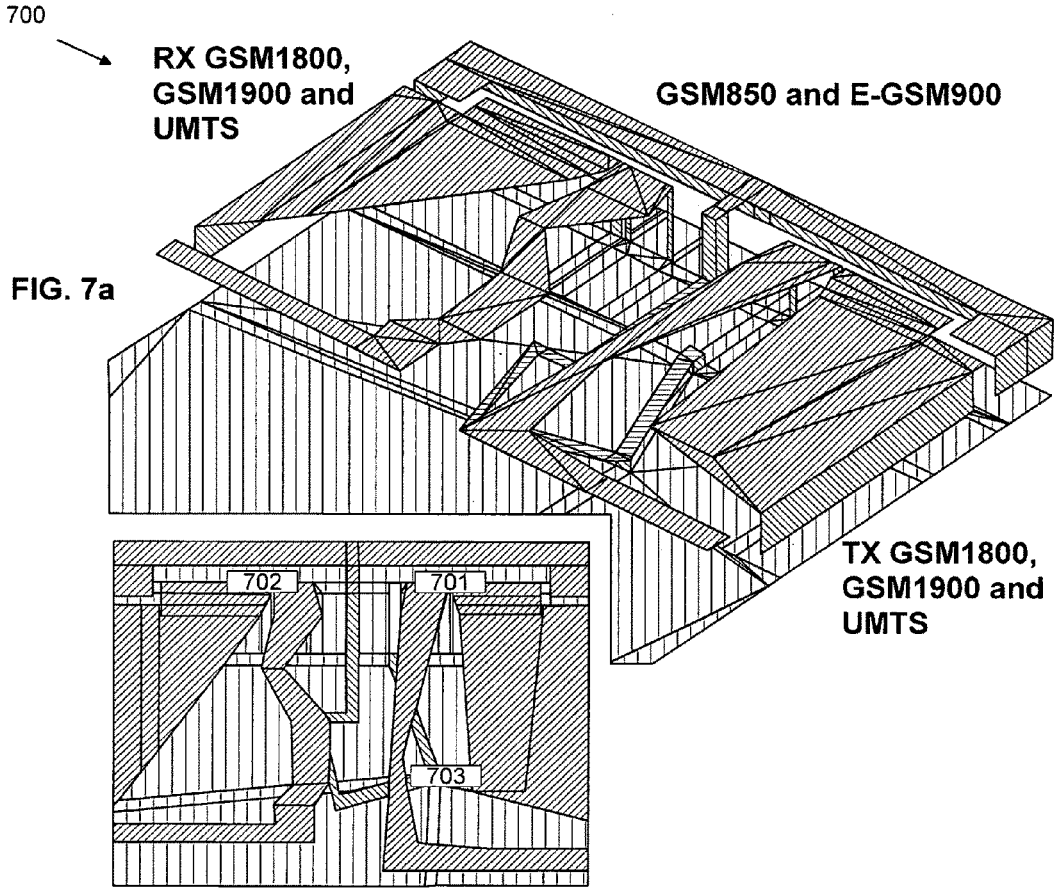
FIGS. 7*a* & 7*b* illustrate geometry of a modified first exemplary antenna module according to an advantageous embodiment of the invention.

FIGS. 7*a* & 7*b* illustrate geometry of a modified first exemplary antenna module 700 according to an advantageous embodiment of the invention.

The modified first exemplary antenna module 700 illustrated in FIGS. 7*a* & 7*b* is re-designed for the application of separate TX and RX antennas. In this embodiment the antenna module size is decreased to 28.2 mm×40 mm×5 mm (length×width×height). The ground element dimensions are 115 mm×40 mm (length×width). In this embodiment, the T-shaped top part of the antenna does not extend outside the PWB. To compensate for the decrease of bandwidth, the lower band element is made dual-resonant with a series-resonant LC-circuit connected in series with the original antenna feed (see FIG. 8*c*).

Antenna feed 703 is for GSM850/900 TX & RX; feed 702 is for GSM1800/1900/UMTS RX; and feed 701 is for GSM1800/1900/UMTS TX.

Figure 8A:
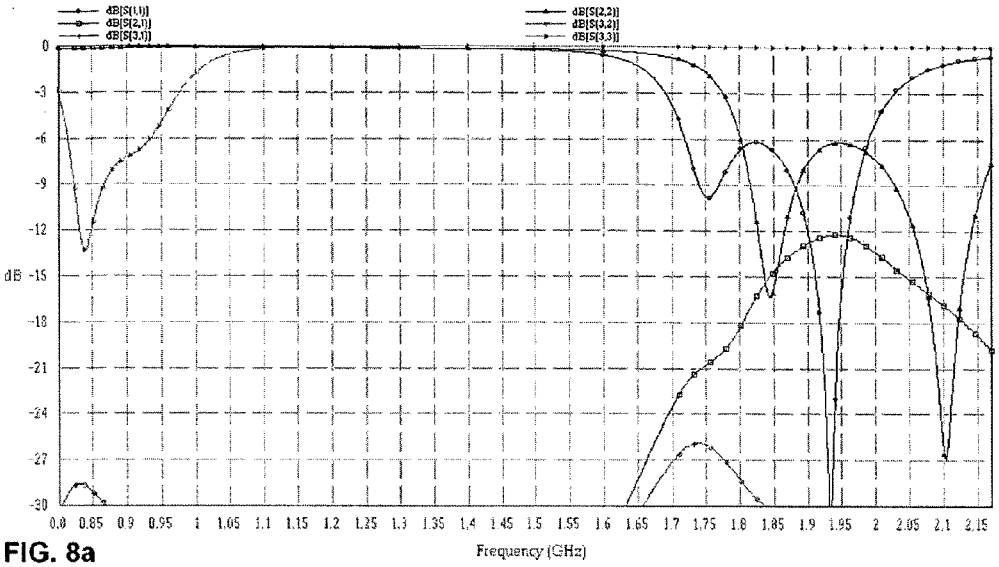
FIGS. 8*a*-8*c* illustrate simulated frequency responses of S-parameters for the modified first exemplary antenna module in free space.
Figure 8B:
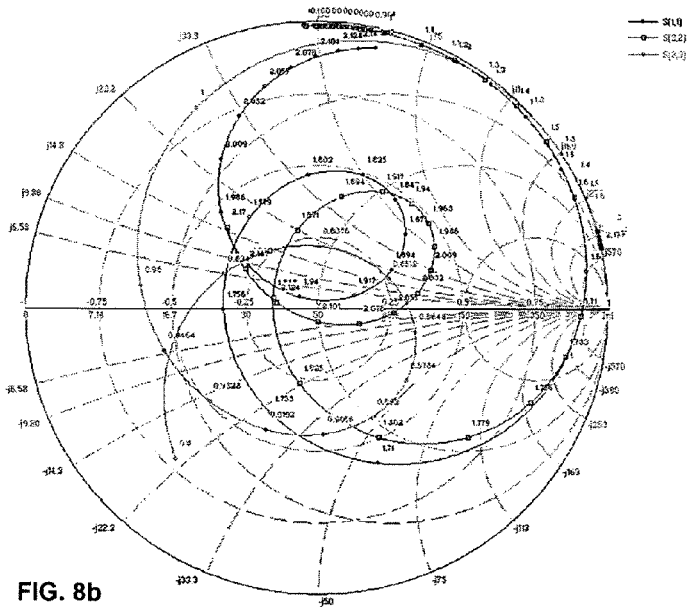
Figure 8C:
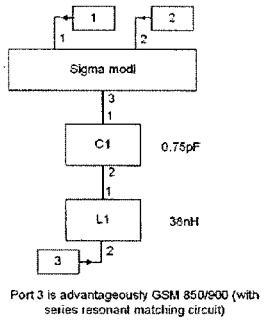

FIGS. 8*a*-8*c* illustrate simulated frequency responses of S-parameters for the modified first exemplary antenna module (described in FIGS. 7*a* & 7*b*) in free space. Especially FIG. 8*a* illustrates reflection coefficients and couplings between antenna elements, FIG. 8*b* reflection coefficients of the antennas on the Smith chart, and FIG. 8*c* a matching circuit for the lower GSM band (port 3).

In this embodiment the impedance bandwidth at the lower GSM band is slightly smaller than required. However, based on the Smith chart of FIG. 8*b* the matching circuit is not optimally tuned, but it is clearly possible to increase the bandwidth so that it covers GSM850/900 bands with at least 6 dB return loss. The desired 6 dB match is achieved at the upper GSM and UMTS bands.

In any of the embodiments outlined above it may be possible that any of these antennas may be frequency tunable so as to cover different frequency bands dependent upon the mode of operation of the mobile communication device.

The invention has been explained above with reference to the aforementioned embodiments, and several advantages of the invention have been demonstrated. It is clear that the invention is not only restricted to these embodiments, but comprises all possible embodiments within the spirit and scope of the inventive thought and the following patent claims. Each feature disclosed in the description, and (where appropriate) the claims and drawings may be provided independently or in any appropriate combination. Especially it should be clear for the skilled person that a mobile terminal, such as a mobile phone, can comprise at least one of the embodiments of the antenna module described in the following patent claims.

The invention claimed is:

1. An apparatus comprising:

a ground plane having a longitudinally dipole-like resonant mode;

a first antenna configured to excite the dipole-like resonant mode of the ground plane and to feed against the ground plane;

a second antenna configured to feed against the ground plane; and a third antenna configured to feed against the ground plane, where the second antenna and the third antenna are each configured to cover at least one of a first, second, third or fourth frequency band;

wherein said second antenna and said third antenna are substantially in the same plane and define a planar surface, the second antenna is positioned at a first corner of the planar surface, said first corner defining a first edge, the third antenna is positioned at a second corner of the planar surface, said second corner defining a second edge, and the first antenna extends from the first edge to the second edge of the planar surface.

2. An apparatus according to claim 1, wherein the first antenna is positioned so that it is adjacent to the second antenna and the third antenna.

3. An apparatus according to claim 2, further comprising a matching circuit coupled to the first antenna and the ground plane coupled to the antenna wherein the first antenna, the matching circuit and the ground plane form a resonant element covering a fifth frequency range.

4. An apparatus comprising the antenna of claim 1.

5. An apparatus comprising:

a first antenna configured to excite a dipole-like resonant mode of a ground plane and to feed against the ground element;

a second antenna configured to feed against the ground element; and a third antenna configured to feed against the ground element, where the second antenna and the third antenna are each configured to cover at least one of a first, second, third or fourth frequency band;

wherein the second antenna and the third antenna are substantially in the same plane and define a planar surface, the second antenna is positioned at a first corner of the planar surface, said first corner defining a first edge, the third antenna is positioned at a second corner of the planar surface, said second corner defining a second edge, and the first antenna extends from the first edge to the second edge of the planar surface, the apparatus is configured to be coupled to a printed circuit board comprising the ground plane and a matching circuit, the first antenna, said matching circuit and the ground plane form a third resonant element covering a fifth frequency range, and the first antenna extends partly outside a perimeter defined by the ground plane.

6. An apparatus according to claim 5, wherein the first antenna is positioned along an axis configured to be parallel to an edge of the printed circuit board when the apparatus and printed circuit board are coupled.

7. An apparatus according to claim 5, comprising a support structure wherein the first antenna and the second antenna and the third antenna are located on a surface of said support structure.

8. An apparatus according to claim 5, wherein the first antenna and the second antenna and the third antenna form a substantially U shaped pattern.

9. An apparatus according to claim 5, wherein the second antenna and the third antenna are dual-resonant antennas.

10. An apparatus according to claim 5, wherein the second antenna is a main antenna and the third antenna is a diversity antenna.

11. An apparatus according to claim 5, wherein the second antenna is a separate TX antenna and the third antenna is a separate RX antenna.

12. An apparatus according to claim 5, wherein the third resonant element and the second antenna cover the first, second and fifth frequency bands and the third antenna covers the third and fourth frequency bands.

13. An apparatus according to claim 12, wherein the first, second and fifth frequency bands are GSM frequency bands and the third and fourth frequency bands are WCDMA frequency bands.

14. An apparatus according to claim 5, wherein a feed of the third resonant element is combined with a feed of at least one of the second antenna and the third antenna.

15. An apparatus according to claim 5, wherein the second antenna and the third antenna are implemented by two resonant stacked antennas.

16. An apparatus according to claim 5, wherein the first antenna is a T-shaped antenna.

17. An apparatus according to claim 5, wherein the second antenna and the third antenna are positioned symmetrically and coincide with corners defined by the ground plane.

18. An apparatus according to claim 5, further comprising a tuning circuit configured to allow tuning any one of the second antenna and the third antenna to operate at only one of the first, second, third of fourth frequency bands.

19. An apparatus according to claim 5, wherein the matching circuit is realized as a short-circuited section of microstrip line.

20. An apparatus according to claim 5, wherein the matching circuit is located between the second antenna and the third antenna.

21. An apparatus according to claim 5, wherein the matching circuit is located on the opposite side of the ground plane than the second antenna and the third antenna.

22. A mobile terminal comprising the apparatus of claim 5.

* * * * *